US007050599B2

(12) United States Patent
Baskerville

(10) Patent No.: US 7,050,599 B2
(45) Date of Patent: May 23, 2006

(54) COMMUNICATIONS EARPIECE AND METHOD OF ATTENUATING ACOUSTICAL SIGNALS

(75) Inventor: Orval Baskerville, Surrey (CA)

(73) Assignee: Custom Protect Ear Inc., Vancouver (CA)

( * ) Notice: Subject to any disclaimer, the term of this patent is extended or adjusted under 35 U.S.C. 154(b) by 0 days.

(21) Appl. No.: 10/936,700

(22) Filed: Sep. 9, 2004

(65) Prior Publication Data

US 2005/0031146 A1 Feb. 10, 2005

Related U.S. Application Data

(63) Continuation of application No. 09/986,739, filed on Nov. 9, 2001, now abandoned.

(51) Int. Cl.
*H04R 25/00* (2006.01)

(52) U.S. Cl. ..... 381/381; 381/324; 381/382

(58) Field of Classification Search ..... 381/315, 381/322, 324–325, 327–328, 330, 370, 371–372, 381/380–382; 181/129–131
See application file for complete search history.

(56) References Cited

U.S. PATENT DOCUMENTS 2,545,731 A * 3/1951 French ..... 381/382
2,573,132 A * 10/1951 French ..... 381/382
3,732,382 A * 5/1973 DeWitt ..... 181/130
4,311,206 A * 1/1982 Johnson ..... 381/328
4,375,016 A * 2/1983 Harada ..... 381/380
4,683,587 A * 7/1987 Silverman ..... 181/129
5,488,205 A * 1/1996 Major ..... 181/130

* cited by examiner

*Primary Examiner*—Suhan Ni
(74) *Attorney, Agent, or Firm*—Dilip C. Andrade; Borden Ladner Gervais LLP

(57) ABSTRACT

A communications earpiece includes a member shaped to fit within an ear canal. The member has a passageway extending therethrough. There is a filter communicating with the passageway. The filter has a passageway extending therethrough and is aligned with the passageway in the member. The passageway in the filter has at least a portion which is narrower than the passageway in the member. Preferably the passageway in the filter has a first section and a second section. The second section is narrower than the first section and the passageway in the member. A method of attenuating acoustical signals in the communications earpiece is also provided. The earpiece has a member shaped to fit within an ear canal. The member has a passageway extending therethrough. The method comprises placing a restriction in the earpiece which is substantially narrower than the passageway and which communicates with the passageway.

18 Claims, 2 Drawing Sheets

COMMUNICATIONS EARPIECE AND METHOD OF ATTENUATING ACOUSTICAL SIGNALS

RELATED APPLICATION

This is a continuation of U.S. patent application Ser. No. 09/986,739 filed on Nov. 9, 2001 now abandoned.

BACKGROUND OF THE INVENTION

This invention relates to communications earpieces and methods of attenuating acoustical signals in such earpieces.

Communications earpieces are used to communicate acoustical signals to the ear of the user. One type of earpiece includes a flexible member which fits within the ear canal of the user. An acoustical conduit, typically a flexible tube, connects the earpiece to a miniature speaker which, in turn, is connected to a communications device such as a radio.

One specific application of such earpieces is for police officers operating vehicles such as motorcycles. The use of an earpiece is advantageous, as opposed to using a loudspeaker on the radio, for reasons of privacy as well as overcoming the distractions of ambient sounds, such as the sound of a motorcycle engine. However, the use of a common earpiece has certain disadvantages as well. For one thing, the sound conducted by the earpiece may prevent the wearer from hearing important sounds, such as a warning shouted by another individual. Also, on occasion sounds produced by a receiving device, such as a two-way radio, may be so loud that they may damage the hearing of the user, particularly over an extended period of time.

In other words, it is important that the ear of the user receive the acoustical signal from, for example, the radio, but that the hearing of the ear should not be completely occluded. Otherwise, it may be possible for someone to sneak up on a police officer utilizing the device without his or her knowledge.

Accordingly, it is an object of the invention to provide an improved communications earpiece, as well a method of attenuating acoustical signals in a communications earpiece so hearing by the ear is not occluded by the signal from a radio or other such device.

It is another object of the invention to provide an improved communications earpiece and method of attenuating acoustical signals in a communications earpiece whereby the volume of acoustical signals reaching the ear of the user is limited.

It is a further object of the invention to provide an improved communications earpiece which is simple and inexpensive to produce, is robust in construction and reliable in operation.

SUMMARY OF THE INVENTION

According to one aspect of the invention, there is provided a communications earpiece which includes a member shaped to fit within an ear canal. The member has a passageway extending therethrough. There is a filter communicating with the passageway. The filter has a passageway extending therethrough which is aligned with the passageway in the member. The passageway in the filter has at least a portion which is narrower than the passageway in the member.

Preferably, the passageway in the filter has a first section and a second section, the second section being narrower than the first section and narrower than the passageway in the member.

According to another aspect of the invention, there is provided a communications device comprising a communications earpiece having a member shaped to fit within an ear canal. The member has a passageway extending therethrough. There is a filter communicating with the passageway. The filter has a passageway extending therethrough which is aligned with the passageway in the member. The passageway in the filter has at least a portion which is narrower than the passageway in the member. The device also includes an acoustical conduit connected to the earpiece. An acoustical chamber member is connected to the acoustical conduit. A miniature speaker is connected to the acoustical chamber member. A jack is connected to the miniature speaker for connecting the communications device to a radio.

The invention provides significant advantages compared to the prior art. Principally it allows the user, such a motorcycle police officer, to monitor a communications device, such as a radio, without significantly impairing the user's ability to monitor ambient sounds. The hearing in the ear fitted with the communications device is not completely occluded.

Moreover, the device is significantly safer than other earpieces which could be utilized. This is because the maximum volume reaching the user's ear is limited and can be kept at a level below the volume which would damage the user's ear. In brief, the device is significantly safer and more effective than prior art communications devices and more desirable than loudspeakers which give the user no degree of privacy for communications received.

BRIEF DESCRIPTION OF THE PREFERRED EMBODIMENTS

Figure 1:
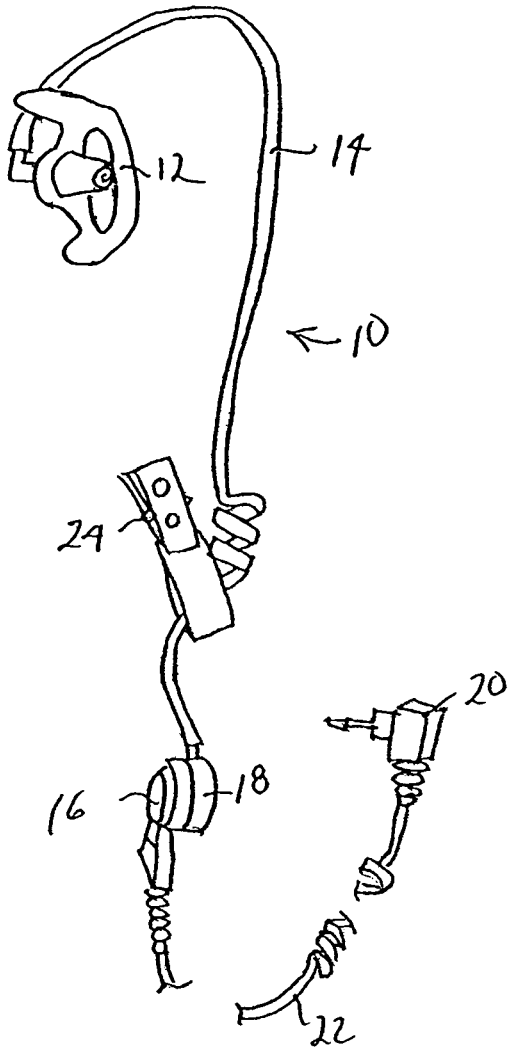
FIG. 1 is an isometric view, partly broken away, of a communications device according to an embodiment of the invention.
Figure 5:
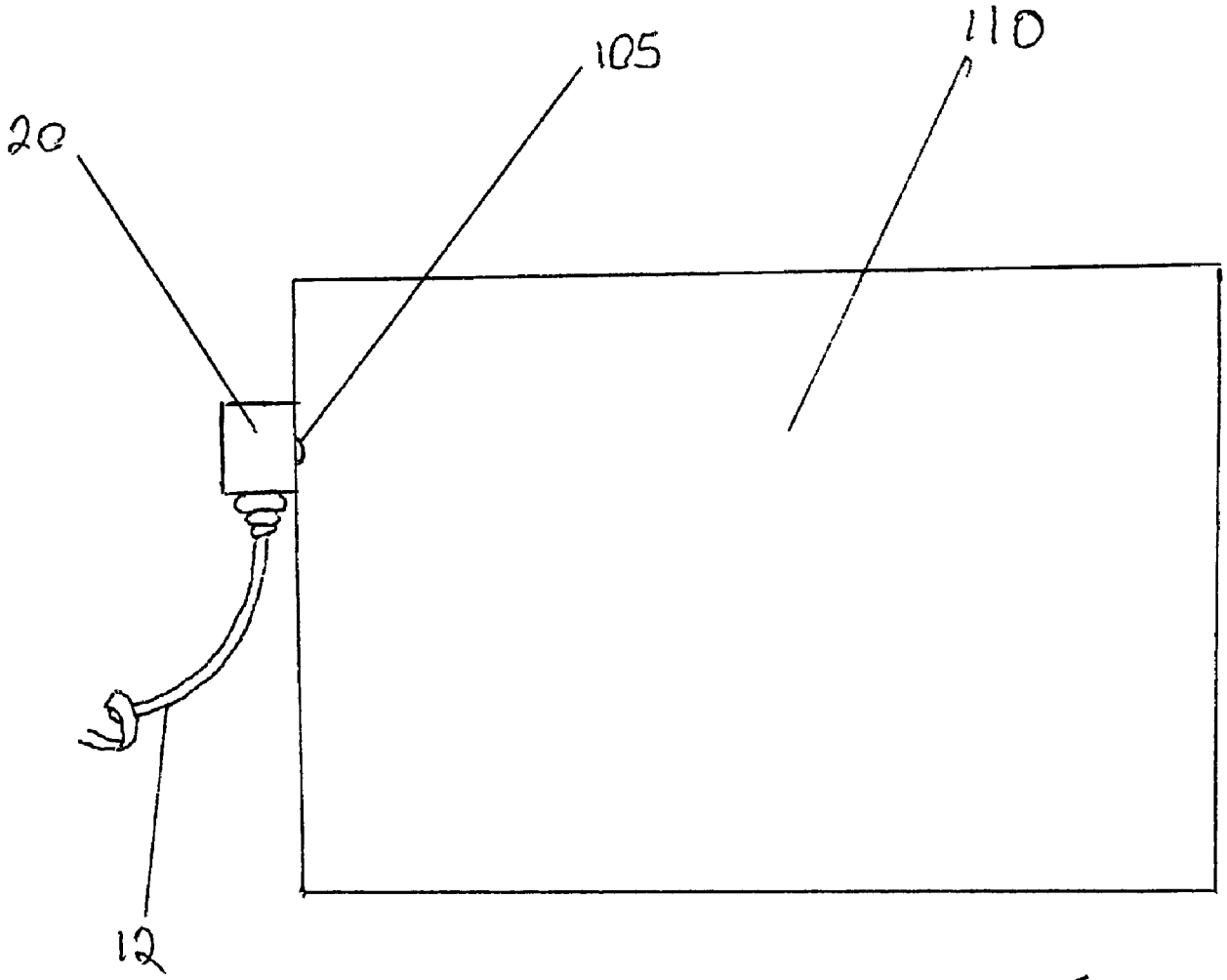
FIG. 5 is an elevational view of the plug thereof and an electronic communications device connected thereto.

Referring to the drawings, and first to FIG. 1, communications device 10 includes an earpiece 12, commonly known as a snail, an acoustical conduit 14, a miniature speaker 16, an acoustical chamber 18 connected to the miniature speaker, and a plug 20 connected to the miniature speaker by cable 22. There is also a collar clip 24 used to affix the device to the collar of the user. The plug 20 is used to connect the communications device to a jack in a radio, telephone or other such communications device. FIG. 5 show the plug 20 connected to a jack 105 of an electronic communications device 110.

Figure 2:
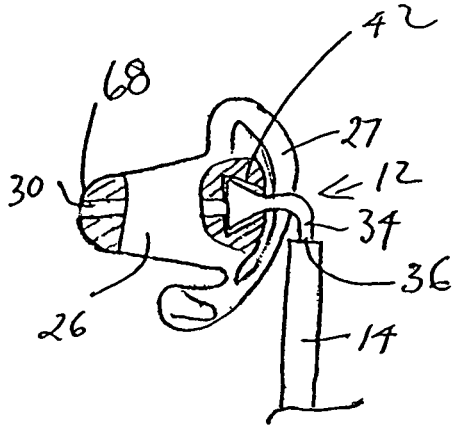
FIG. 2 is an elevational view, partly broken away, of the communications earpiece thereof and fragment of an acoustical conduit connected thereto.

Referring to the communications earpiece in more detail, and with reference to FIG. 2, this includes a member 26 which is generally conical-shaped in this example so as to fit within the ear canal of the user. The earpiece includes an outer portion 27 connected to the member 26 which is complemefltary in shape to the outer ear of the individual, whereby the earpiece is easily retained in the ear of the individual with the member 26 extending into the ear canal. The earpiece in this example is of silicone, in particular Dow Corning's Medical Grade silicone MDX440. However other types of silicone or other materials could be substituted. As described thus far, the earpiece is generally conventional and would be well understood by someone skilled in the art.

The member 26 has a passageway 30 extending therethrough, as does the prior art. In this particular example, the passageway is 2 mm in cross-sectional extent. In this example, the passageway is circular in section and the cross-sectional extent is the diameter of the passageway. However the passage could be of other shapes besides the circular shape.

The earpiece also includes a connector, in the form of elbow 34, which is used to connect the acoustical conduit 14 to the earpiece. The conduit 14 fits over end 36 of the elbow.

Figure 3:
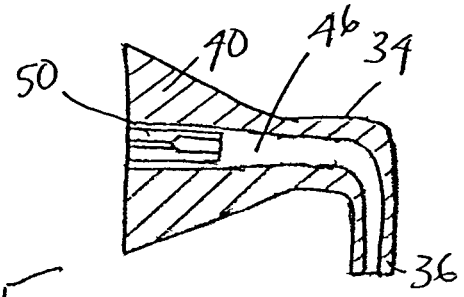
FIG. 3 is a sectional view of the housing, filter and connector thereof.

As seen in better detail in FIG. 3, the elbow 34 has a conical filter housing 40 connected thereto. In this example the elbow and the conical housing form a unitary structure, although in other embodiments they could be separate components which are otherwise fitted or connected together. The conical filter housing 40 fits tightly within conical, internal cavity 42 of the member 26 as shown in FIG. 2. The conical shape helps to maintain the filter housing within the cavity. It should be understood however that in other embodiments the filter housing and cavity could be of different shapes, such as a cylindrical shape. Alternatively, the elbow 34 could be fitted directly into the passageway 30 of the earpiece. Elbow 24 of this example has an interior passageway equal in diameter to passageway 30 or 2 mm in other words.

A passageway 46 extends through the elbow and is 2 mm in cross-sectional extent in this example. In other examples, both the passageway 46 and passageway 30 of the earpiece could be of different diameters or cross-sectional extents, but preferably the cross-sectional extent of both should be between 0.5 mm and 2 mm.

A filter 50 is located within the passageway 46 so it communicates with the passageway 46 as well as passageway 30 in member 26. The filter acts as a restriction in the acoustical conduit continuing from conduit 14, through passageway 46 of elbow 34 and into passageway 30 of the member 26.

Figure 4:
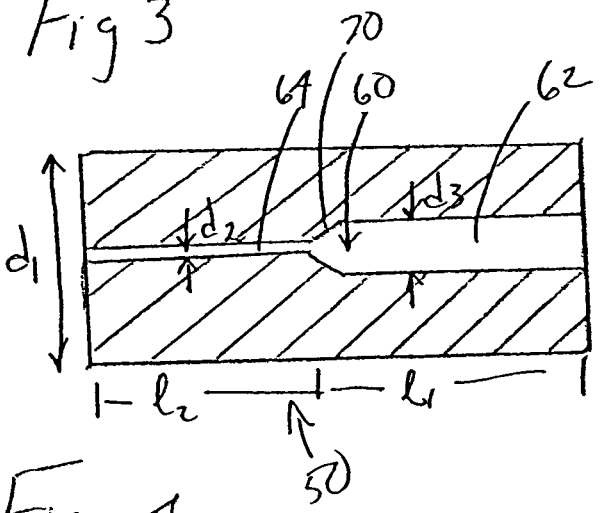
FIG. 4 is a sectional view of the filter thereof.

FIG. 4 shows the filter 50 in more detail. In this example the cross-sectional extent or diameter $d_1$ of the filter is 2 mm, which corresponds with the diameter of the passageways 30 and 46. However in other embodiments, the diameter could be different. The filter has a passageway 60 which is aligned with the passageway 30 in member 26 as well as the passageway 46 shown in FIG. 3. This passageway has first section 62 and a second section 64. It may be seen that the second section is significantly narrower than the first section. Likewise it may be seen that the first section is narrower than the passageway 30 in the earpiece which corresponds to diameter $d_1$.

The first section in this embodiment has a cross-sectional extent or diameter $d_3$ of 0.89 mm. In other embodiments the size could vary between 0.5 mm and 1.2 mm.

The section 64 is closer to inner end 68 of the member 26, which extends furthest into the ear canal, than the first section 62. In this example the second section has a diameter $d_2$ of 0.34 mm. In other examples the cross-sectional extent could be between 0.15 mm and 0.5 mm.

The first section has a length $l_1$ of 3.3 mm. In other examples this length could be between 1.5 mm and 3.5 mm. The second section 64 has a length $l_2$ of 2.5 mm in this example. In other examples the length could be between 1.5 mm and 3.5 mm.

There is a frusto-conical surface 70 which acts as a transition between the first section 62 and second section 64 of passageway 60. In this example the sides of the frusto-conical section are at a 30° angle. In other embodiments the angle could be different, the shape of the section could be different or omitted entirely.

The effect of the filter 50 is to control soundwaves before they reach the ear of the user. Sound waves are chopped or squeezed to uniform size. When a sound wave reaches the filter, it is squeezed further in the first section 62. However only a portion of the sound energy can penetrate the relatively small openings of section 64. When the sound wave exits the second section, it expands back to the size it was when it entered the filter since the passageways 46 and 30 are the same size, 2 mm in this example. The squeezing and expansion result in controlling the maximum volume of the signal delivered to the ear. This is particularly useful with radio communications when two people key a microphone at the same time. When this happens the radio emits a loud squeal which can cause hearing loss if the signal is delivered directly to the ear. This does not occur with the use of a filter.

It should be understood that in this example the filter 50 is a separate member. In other examples the filter could be formed by appropriately shaped and sized passageways in the housing 40 or as part of the earpiece 26 itself.

It will be understood by someone skilled in the art that many of the details provided above are by way of example only and are not intended to limit the scope of the invention which is to be interpreted with reference to the following claims.

What is claimed is:

1. In combination:

a member, the member being shaped to fit in an ear canal and having a passageway extending therethrough;

a volume regulator having a extending therethrough and having first and second sections, the first section being narrower in diameter than the passageway in the member, and the second section being narrower in diameter than the first section and in communication with the passageway in the member;

an acoustical conduit having an inner diameter about equal to that of the passageway in the member, the acoustical conduit in communication with the first section of the volume regulator;

a speaker, the speaker communicating with the acoustical conduit; and an electronic communications device, the electronic communications device being operatively connected to the speaker, and the electronic communications device being selected from the group including telephones and radios.

2. The combination as claimed in claim 1, wherein the member has an inner end which extends furthest into the ear canal, the second section of the passageway in the volume regulator being closer to the inner end of the member than the first section of the passageway in the volume regulator.

3. The combination as claimed in claim 2, including a frusto-conical section between the first section and the second section of the passageway in the volume regulator.

4. The combination as claimed in claim 3, wherein the frusto-conical section has sides at a 30° angle.

5. The combination as claimed in claim 2, wherein the combination further includes a connector for connecting the acoustical conduit to the member, the volume regulator being between the connector end the passageway in the member.

6. The combination as claimed in claim 5, wherein the member has an internal cavity communicating with the passageway therethrough, the volume regulator being housed within the cavity and the connector being connected to the volume regulator.

7. The combination as claimed in claim 6, wherein the cavity is conical.

8. The combination as claimed in claim 2, wherein the second section of the passageway in the volume regulator is between 0.15 mm and 0.5 mm in cross-sectional extent.

9. The combination as claimed in claim 2, wherein the second section of the passageway in the volume regulator is 0.34 mm in cross-sectional extent.

10. The combination as claimed in claim 8, wherein the first section of the passageway in the volume regulator is between 0.5 mm and 1.2 mm in cross-sectional extent.

11. The combination as claimed in claim 10, wherein the passageway in the member is between 0.5 mm and 2 mm in cross-sectional extent.

12. The combination as claimed in claim 11, wherein the passageway in the member is 2 mm in cross-sectional extent.

13. The combination as claimed in claim 2, wherein the passageway in the volume regulator is 4 mm to 10 mm long.

14. The combination as claimed in claim 2, wherein the first section of the passageway in the volume regulator is 1.5 mm to 3.5 mm long.

15. The combination as claimed in claim 2, wherein the first section of the passageway in the volume regulator is 3.3 mm long.

16. The combination as claimed in claim 2, wherein the second section of the passageway in the volume regulator is 1.5 mm to 3.5 mm long.

17. The combination as claimed in claim 2, wherein the second section of the passageway in the volume regulator is 2.5 mm long.

18. The combination as claimed in claim 1, wherein the member is of silicone.

* * * * *